United States Patent [19]

Bacvarov

[11] 4,063,691

[45] Dec. 20, 1977

[54] DRUM FOR TRANSPORTATION OF FLEXIBLE ELECTRIC POWER CABLE

[75] Inventor: Dosio C. Bacvarov, Greensburgh, Pa.

[73] Assignee: I-T-E Imperial Corporation, Spring House, Pa.

[21] Appl. No.: 661,121

[22] Filed: Feb. 25, 1976

[51] Int. Cl.[2] ..... B65H 75/14; B65H 75/40

[52] U.S. Cl. ..... 242/54 R; 174/10; 242/77; 242/117; 242/159

[58] Field of Search ..... 242/117, 54 R, 96, 99, 242/100, 104, 50, 71.8, 222, 61, 77, 77.1, 79.4, 118.8, 118.7, 159; 254/175.7, 186 R, 186 HC; 174/10; 138/178

[56] References Cited

U.S. PATENT DOCUMENTS 2,029,427 2/1936 Klau ..... 242/61

*Primary Examiner*—George F. Mautz

*Attorney, Agent, or Firm*—Ostrolenk, Faber, Gerb & Soffen

[57] ABSTRACT

A drum for transportation of flexible electrical cables has an oval cross-section and is formed of a spool member comprising a pair of semi-cylindrical sections and means for rigidly maintaining the sections with their diametric surfaces spaced parallel to and facing each other. A planar retainer member of corresponding oval cross-section and uniformly greater dimensions than the spool member is secured to each flat end of the spool member transverse to the axes of rotation of the sections to form a pair of spaced opposed walls of a rectangular slot receiving at least one layer of a continuous length of cable for shipment.

3 Claims, 5 Drawing Figures

FIG. 1.
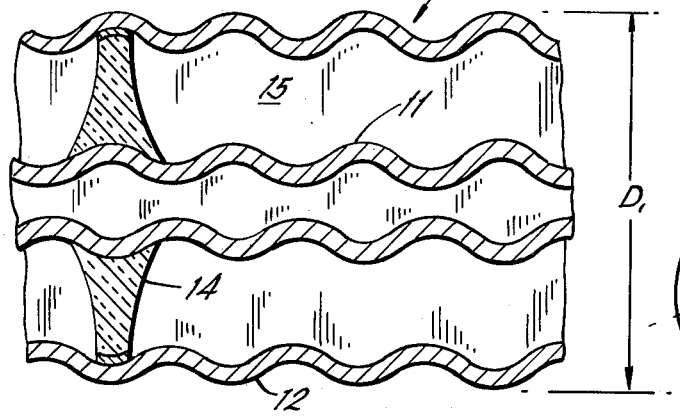
FIG. 2.
PRIOR ART
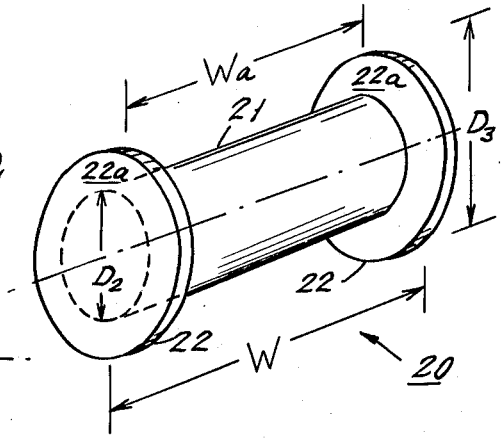
FIG. 3.
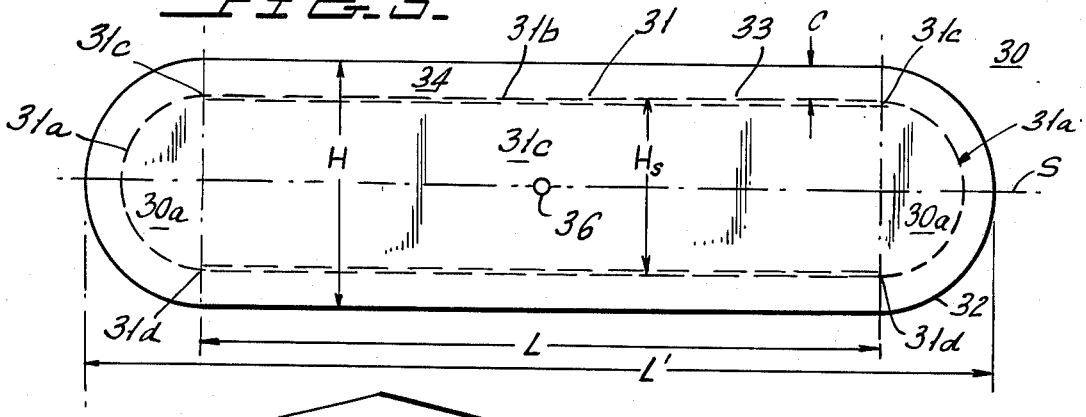
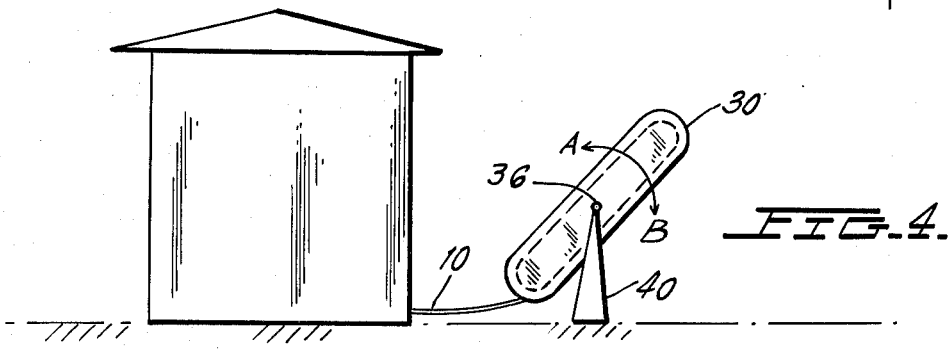
FIG. 4.
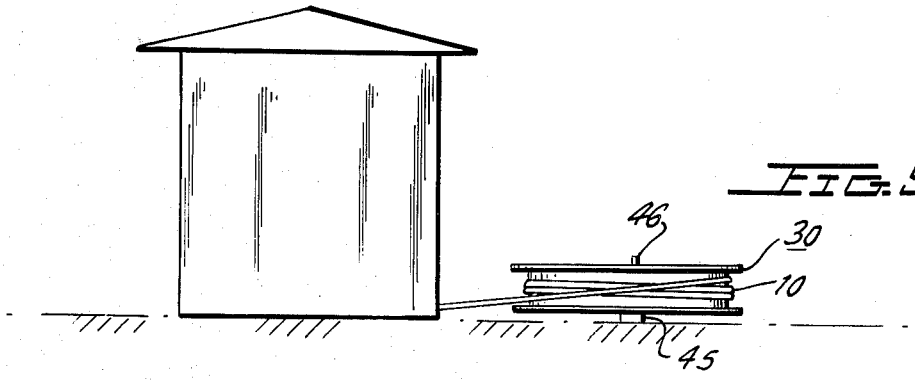
FIG. 5.

DRUM FOR TRANSPORTATION OF FLEXIBLE ELECTRIC POWER CABLE

BACKGROUND OF THE INVENTION

The present invention relates to transportation drums and more particularly to a novel drum for transportation of a long and continuous length of a flexible electric power cable.

Flexible cables capable of carrying voltages in excess of 230 KV. are gaining increased industrial acceptance, particularly for underground installation. The extremely high voltage (EHV) cables have relatively large diameters due to the increased thickness of the insulation required. Cables of the gas-insulated type, especially, may eventually be produced with outer diameters as large as 18 inches. The largest diameter flexible cable presently available, and which is capable of being wound upon a drum has an outer diameter of about 6 inches and is used for radio frequency power transmission purposes. A useful continuous length of this relatively "small" cable can be wound on a correspondingly "small" drum and easily shipped. As the outer diameter of the cable increases, the continuous length of cable which can be wound upon a drum for transportation from the plant of the cable manufacturer to the installation location decreases. Due to road and rail clearance limitations, the cable drums can have a maximum diameter of the order of 12–15 feet, to allow passage beneath overpasses and tunnels, and a maximum width of 8 feet, to prevent drum overhang into an adjacent track or traffic lane. The dimension restrictions on the cable drum so severely limit the practical continuous winding length of cable which can be wound upon a single drum for shipment that cables with an outer diameter greater than 9 inches cannot be drum wound and must instead be shipped in straight lengths. Thus, several relatively short continuous cable lengths, each of the order of 40 feet long, must be spliced on-site to provide a desired length of EHV cable for installation. Such on-site splicing is expensive and time consuming since contaminating matter which may eventually cause electrically weak points to develop along the length of the cable must be excluded during splicing.

It is desirable to provide a drum on which a relatively large diameter flexible electrical power cable can be wound and to enable transportation of as long a continuous length of this previously non-drum-transportable corrugated cable as possible, without exceeding the maximum height and width dimensions imposed by transportation requirements.

BRIEF SUMMARY OF THE INVENTION

In accordance with the invention, a novel drum for transportation of flexible corrugated electric power cable, realizing the above stated goal, comprises a pair of semi-cylindrical end sections having a maximum diameter and axial width consistent with vehicular transportation requirements and having their arcuate portions positioned away from each other, and means for rigidly maintaining the end sections with their diametric surfaces spaced parallel from each other to form a spool member of oval cross-section. The exterior surface of the spool member forms the floor of a channel. A planar retainer member is secured to each flat end of the spool member to form the side walls of the rectangular channel, capable of receiving at least one layer of flexible cable.

In one preferred embodiment, the longest dimension of the drum is increased to the order of 75 feet, while the height and width of the drum remain within the maximum dimensions of 15 feet and 8 feet, respectively, as required for vehicular transportation. The oval drum enables shipment of a single continuous length of corrugated cable of diameter up to about 18 inches.

Accordingly, it is one object of the present invention to provide a novel drum for transportation of flexible electric power cable.

This and other objects of the invention will become apparent upon the reading of the following detailed description and the accompanying drawing figures.

BRIEF DESCRIPTION OF THE FIGURES

FIG. 1 is an axial cross-sectional view of a portion of a flexible corrugated electric power cable, and useful in understanding the principles of the present invention;

FIG. 2 is a perspective view of a conventional drum for transportation of conventional flexible electric power cable;

FIG. 3 is a view in side elevation of a flexible cable transportation drum in accordance with the principles of the invention; and FIGS. 4 and 5 are illustrations of two possible installations of the novel drum of the present invention, illustrating winding or unwinding of a flexible power cable thereon.

DETAILED DESCRIPTION OF THE INVENTION

Referring now to the Figures, existing flexible transmission cable 10, such as described in U.S. Pat. No. 3,792,188, issued Feb. 12, 1974, and assigned to the assignee of the present invention, comprises a central corrugated conductor 11 which is enclosed by a corrugated conductive housing 12. Existing cables 10 have a maximum outer diameter $D_1$ of about 6 inches; cables having an outer diameter $D_1$ of 18 inches have been proposed. Conductor 11 is sized in accordance with the current which must be carried by the transmission line, and is conventionally supported within corrugated housing 10 by insulator means, such as a plurality of radial spacers 14 or the like. Volume 15 intermediate inner conductor 11 and corrugated housing 12 is filled with an insulating gas, such as $SF_6$ or the like.

Flexible corrugated cable 10 may be wound upon a drum for vehicular transportation to an installation site. A Typical drum 20 (FIG. 2) comprises a cylindrical spool 21 having a diameter $D_2$ and a width $W_a$. A circular retainer 22 having a diameter $D_3$, greater than spool diameter $D_2$, is affixed in axial alignment at each end of spool 21. A continuous length of cable 10 may be wound in at least one layer within the generally rectangular-shaped channel formed by the parallel spaced annular portions **22*a* of end pieces 22 positioned substantially perpendicular to the exterior surface of spool 21. The maximum overall width W and height $D_3$ of spool 20 are regulated by the maximum dimensions transportable on highway and railway vehicles and are of the order of 8 feet and 15 feet, respectively. For such a drum, a spool diameter $D_2$ of 10 feet may be used allowing winding of 600 feet of 12 inch outer diameter flexible cable 10** in two layers or 200 feet of 18 inch outer diameter flexible cable in a single layer.

As considerably longer continuous lengths of cable are required for a typical installation, several cable lengths must be spliced and sealed on-site, resulting in an expensive and time consuming process since contaminating material must be excluded from the interior volume 15 of cable 10 during splicing or the electrical insulation of the completed cable will eventually weaken.

Referring now to FIG. 3, a novel drum 30 will not only allow winding of a practical length of relatively large outer diameter cable for shipment while meeting the above-stated width and height requirements, but will also provide for transportation of continuous flexible cable lengths several times longer than practical with a cylindrical drum 20.

Vehicular transportation facilities can accommodate objects having a length dimension considerably greater than the severely-restricted width dimension. Drum 30 has an oval cross-section to increase the drum length while utilizing a pair of spaced rounded end sections 30*a*, about which a length of flexible cable 10 may be gradually bent to change the running direction thereof during drum winding.

Drum 30 comprises a central spool member 31 having an oval cross-section about a lengthwise line of symmetry S. Spool member 31 is formed of a pair of semi-cylindrical end sections 31*a* having their flat diametric sides positioned parallel to each other and joined by an intermediate section 31*b*. The intermediate section has a height $H_s$, equal to the diameter of each semi-cylindrical end section 31*a*, and a length L. Intermediate section 31*b* may either be a solid or hollow body of rectangular parallelopiped shape integrally joined to end sections 31*a* or a cross-braced framework extending between the end sections and having means, such as sheets 33, or the like, extending between corresponding edges 31*c*—31*c* and 31*d*—31*d* of the end sections to form a channel floor.

Each of a pair of retainer members 32 has an oval cross-section of shape corresponding to the cross-section of spool member 31, but of uniformly larger dimensions, each retainer member having a height H, and length L'. One retainer member is attached to each of the parallel axial end surfaces 31*c* of spool member 31 with the plane of symmetry S of both spool member 31 and retainer members 32 being coincident. Thus, a generally rectangular channel is formed into the periphery of oval cross-section drum 30. The channel has a pair of spaced side walls formed by the annular portions 34 of retainer members 32 extending to a height $C = (H-H_s)/2$ above the exterior surface of spool member 31, which exterior surface forms the channel floor.

As the total end-to-end length L' of oval cross-section drum 30 increases to a maximum length of approximately 75 feet, the total transportable length of flexible corrugated cable 10 correspondingly increases to be up to 425% greater than the cable length transportable on a cylindrical spool 20 having the same diameter and width. The magnitude of this percentage increase is tabulated in the following table:

| CABLE DIAMETER (INCHES) | NUMBER OF LAYERS | GREATEST CONTINUOUS LENGTH (FEET) NORMAL DRUM 20 | DRUM 30 L'= 60 FEET | % INCREASE | DRUM 30 L'= 75 FEET | % INCREASE |
|---|---|---|---|---|---|---|
| 9 | 3 | 1000 | 3430 | 343 | 4240 | 424 |
| 12 | 2 | 600 | 1860 | 310 | 2280 | 380 |
| 15 | 2 | 400 | 1300 | 325 | 1600 | 400 |
| 15 | 1 | 220 | 670 | 305 | 820 | 373 |
| 18 | 1 | 200 | 600 | 300 | 740 | 370 |
| | | | AVERAGE INCREASE | 317% | AVERAGE INCREASE | 390% |

Drum 30 includes rotation enabling means, such as a spindle shaft 36 or the like, extending away from the exterior surface of each retainer member 32 and positioned at its center of rotation, along axis of symmetry S and generally midway between the flat diametric surfaces of end sections 31*a*.

The axis of rotation may be placed in either the horizontal plane (FIG. 4), and the drum supported by appropriate means, such as pylons 40 or the like, to allow drum rotation about shaft 36 in the direction of arrow A for winding cable 10 upon drum 30 and in the clockwise direction of arrow B for removing cable 10 from drum 30.

The axis of rotation may be positioned in the vertical plane (FIG. 5) by supporting the drum on a holding means 45; the rotation enabling means may be a simple passageway formed through drum 30 along its axis of rotation at 36 and adapted to receive a vertically-oriented shaft 46 of holding means 45.

There has just been described a novel cable drum having an oval cross-section to enable transportation of practical lengths of flexible corrugated cable while maximizing the continuous transportable length without exceeding vehicular restrictions.

Although there has been described preferred embodiments of this invention, many variations and modifications will now be apparent to those skilled in the art. Therefore, this invention is to be limited, not by the specific disclosure herein, but only by the appended claims.

What is claimed is:

1. In combination, a length of flexible gas-insulated cable having a diameter greater than about 9 inches and an elongated drum for receiving said cable and for transporting said cable; said drum comprising a spool member having an axis of rotation and a pair of flat identical retainer members to define the walls of a channel; said spool member being elongated and having an oval cross-section in a plane perpendicular to said axis; said retainer members having a dimension greater than the dimension of the ends of said spool member, and being secured to the ends of said spool member to define, with the exterior surface of said spool, an annular channel for receiving said cable; said cable being wound around said axis and within said channel for no more than about three layers; said retainer members having a height of about 12 feet, and being spaced from one another by about 8 feet, and having a length greater than about 15 feet.

2. The combination of claim 1 including means mounting said drum for rotation about a horizontal axis.

3. The combination of claim 1 including means mounting said drum for rotation about a vertical axis.

* * * * *